US008777476B2

(12) United States Patent
Torkildsen

(10) Patent No.: US 8,777,476 B2
(45) Date of Patent: Jul. 15, 2014

(54) FLOW CONDITIONING APPARATUS

(75) Inventor: Bernt Helge Torkildsen, Nesttun (NO)

(73) Assignee: Framo Engineering AS, Bergen (NO)

( * ) Notice: Subject to any disclaimer, the term of this patent is extended or adjusted under 35 U.S.C. 154(b) by 0 days.

(21) Appl. No.: 13/225,610

(22) Filed: Sep. 6, 2011

(65) Prior Publication Data

US 2012/0057427 A1 Mar. 8, 2012

(30) Foreign Application Priority Data

Sep. 6, 2010 (GB) ..... 1014765.0

(51) Int. Cl.
*B01F 13/02* (2006.01)
*B01F 13/00* (2006.01)
*B01F 15/00* (2006.01)

(52) U.S. Cl.
USPC ..... 366/101; 366/140; 366/163.2; 366/167.1; 366/173.2

(58) Field of Classification Search
CPC ... B01F 13/0244; B01F 13/0255; B01F 13/02
USPC ..... 366/140, 178.1, 101, 162.4, 150.1, 366/163.1, 163.2, 167.1, 173.1, 173.2
See application file for complete search history.

(56) References Cited

U.S. PATENT DOCUMENTS

| | | | | |
|---|---|---|---|---|
| 4,426,880 | A * | 1/1984 | Walters et al. | 73/61.62 |
| 4,597,950 | A | 7/1986 | Rogers et al. | |
| 5,035,842 | A * | 7/1991 | Mohn | 261/76 |
| 5,254,292 | A | 10/1993 | Gabryelczyk et al. | |
| 5,447,370 | A | 9/1995 | Cessou | |
| 5,494,067 | A | 2/1996 | Levallois et al. | |
| 2006/0032374 | A1 * | 2/2006 | Vrana et al. | 95/258 |

FOREIGN PATENT DOCUMENTS

| | | |
|---|---|---|
| EP | 0379319 | 7/1990 |
| FR | 2688147 | 3/1992 |
| GB | 2000688 | 1/1979 |
| GB | 2201795 | 9/1988 |
| WO | 90/13859 | 11/1990 |

OTHER PUBLICATIONS

UK Search Reports dated Jan. 12, 2011 & Jun. 7, 2011, corresponding to the priority application.

* cited by examiner

*Primary Examiner* — Tony G Soohoo
*Assistant Examiner* — Anshu Bhatia
(74) *Attorney, Agent, or Firm* — Young & Thompson

(57) ABSTRACT

Apparatus for homogenization of multi-phase fluid; the fluid including at least a first phase and a second phase a gaseous phase and a liquid phase; the apparatus including an inner reservoir fluidly communicative with an outer receptacle; the inner reservoir including an inlet for multiphase fluid, an outlet having a smaller cross sectional area than the body for outflow of the first phase and at least one opening into the outer receptacle for outflow of the second phase, the opening being spaced from the first phase outlet; wherein the outer receptacle has an inlet conduit having a neck which at least partially surrounds the inner reservoir outlet.

22 Claims, 4 Drawing Sheets

FLOW CONDITIONING APPARATUS

FIELD OF THE INVENTION

The invention relates to flow conditioning apparatus and particularly to such apparatus when used in the field of hydrocarbon (oil and gas) exploration and production. It has particular application in the homogenization or mixing of fluids, particularly multi-phase fluids.

BACKGROUND OF THE INVENTION

Multi-phase fluids comprise both gas and liquid components and an example would be a well stream extracted from an onshore or subsea well which comprises a mixture of gas and oil. Such a mixture can vary substantially as regards its gas and liquid components. It may comprise slugs of substantially unmixed liquid separated by primarily gaseous portions, as well as portions that are more or less homogeneous. This inconsistency of the nature of the extracted material makes it difficult to handle, in particular by pumping equipment, which can more efficiently and reliably deal with a homogeneous mixture.

Apparatus for homogenizing multi-phase fluids is known from EP-A-0379319 and WO 90/13859 in which a multi-phase fluid is supplied to a reservoir in which it tends to separate into a body of predominantly gaseous phase fluid adjacent to a pool of predominantly liquid phase fluid. The liquid phase flows out of the reservoir via an outlet conduit and a pipe channels gaseous phase fluid through the liquid phase to the outlet. A venturi restriction in the outlet conduit creates suction to draw the gaseous phase into the liquid phase flow at the outlet. Perforations along the length of the pipe draw liquid phase into the gaseous phase and aid the homogenization process.

A problem with these known multi-phase fluid homogenizers occurs when the unprocessed well stream contains sand particles or other solids. The apparatus must then be designed with large flow areas to avoid solids accumulating in narrow sections and blocking the flow or clogging the apparatus. Such accumulation seriously reduces the efficiency of the known apparatus and can prevent it working altogether.

Figure 2:
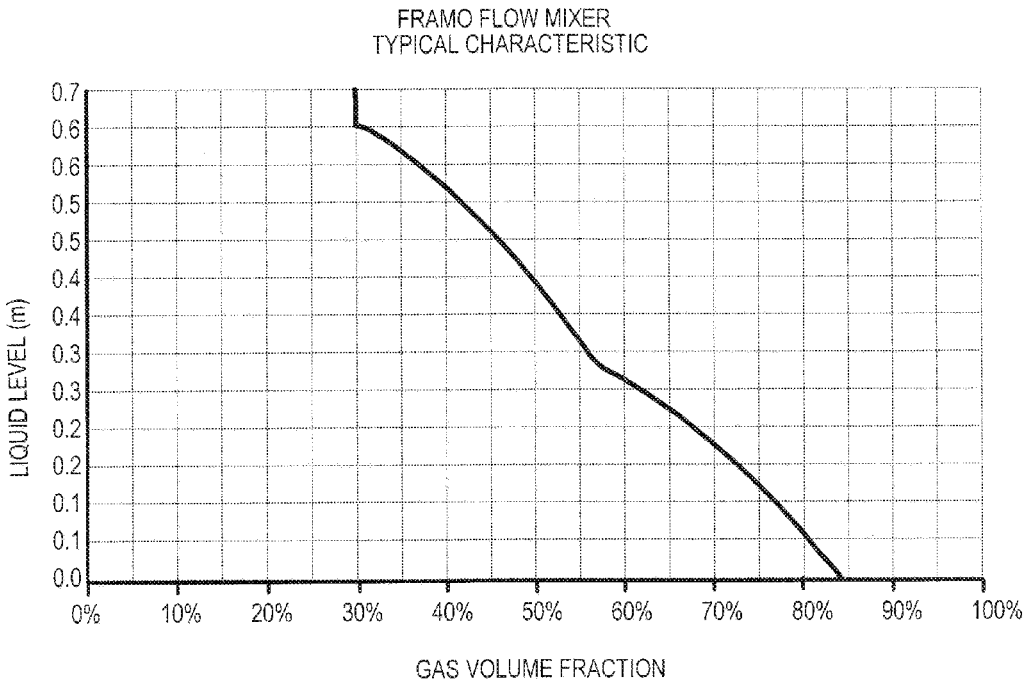

In these known homogenizers, the relative proportions of gas to liquid in the mixture, i.e. the gas volume fraction (GVF) is directly correlated to the level of the liquid in the reservoir, in that the higher the GVF, the lower the liquid level. This relationship determines the optimum operating envelope of the apparatus. The apparatus can be adapted by choosing appropriate flow areas for respective liquid and gas streams in the outlet, combined with appropriate numbers and sizes of perforations in the pipe. For high GVF applications the liquid outflow rate, and hence the cross-sectional area of the outlet conduit, needs to be small and the perforations in the pipe reduced in size or number or both. However if the liquid flow area is made too small it becomes more prone to blockage from solids. Thus there is a practical limit, dependent upon the size and amount of the solid particles in the flow, below which the liquid flow area cannot be reduced without seriously prejudicing the performance of the apparatus. A typical lower limit in gas and oil applications for a liquid flow clearance is about 5 mm and this equates, using a perforated pipe of around 5-30 cm diameter, to a maximum GVF of 90-98% corresponding to a maximum GLR of 10-50. As a result, it is generally difficult to design the known homogenizing apparatus for optimum operation of GLR above 10-50. This is illustrated in FIG. 2.

Multi-phase mixtures with a very high gas volume fraction (GVF) are known as condensate or "Wet Gas"—a geological term for a gaseous mixture of hydrocarbons that contain a significant amount of compounds with molecular weights heavier than methane. Such wet gas fluids typically have a GVF of above approximately 95% corresponding to a gas liquid ratio (GLR) above 20. Typically such fluids also contain other non-hydrocarbon compounds such as carbon dioxide, hydrogen sulphide, nitrogen, oxygen and water.

It would be advantageous to provide apparatus which can efficiently handle high GVF multi-fluid flows, such as Wet Gas flows, without being prone to blockage from solid particles in the flow.

SUMMARY OF THE INVENTION

According to one aspect of the present invention there is provided apparatus for homogenization of multi-phase fluid; the fluid comprising at least a first phase and a second phase a gaseous phase and a liquid phase; the apparatus comprising an inner reservoir fluidly communicative with an outer receptacle; the inner reservoir comprising an inlet for multiphase fluid, an outlet having a smaller cross sectional area than the body for outflow of the first phase and at least one opening into the outer receptacle for outflow of the second phase, the opening being spaced from the first phase outlet; wherein the outer receptacle has an inlet conduit having a neck which at least partially surrounds the inner reservoir outlet.

According to a second aspect of the present invention there is provided a method for homogenizing multi-phase fluid comprising: supplying a multi-phase fluid through an inlet to an inner reservoir which is at least partially surrounded by an outer receptacle; allowing phases of the multi-phase fluid to a least partly separate in the inner reservoir; and drawing off an outlet stream of fluid from the inner reservoir through an outlet comprising a venturi so that fluid is drawn through the outer receptacle into the outlet stream.

The gas component can be drawn from the gas body through one or more apertures in the roof of the reservoir which communicates with the outer receptacle which may at least partially surround the inner reservoir. An internal partition may also be incorporated.

Some of the liquid may also be arranged to flow together with the gas from the reservoir into the outer receptacle to the venturi. The amount or proportion of the gas component which is drawn off from the gas body is inversely proportional to the liquid level and thus decreases as a function of an increase of the liquid level, as more of the perforations are submerged. This serves as an automatic regulation of the gas volume fraction.

Figure 1:
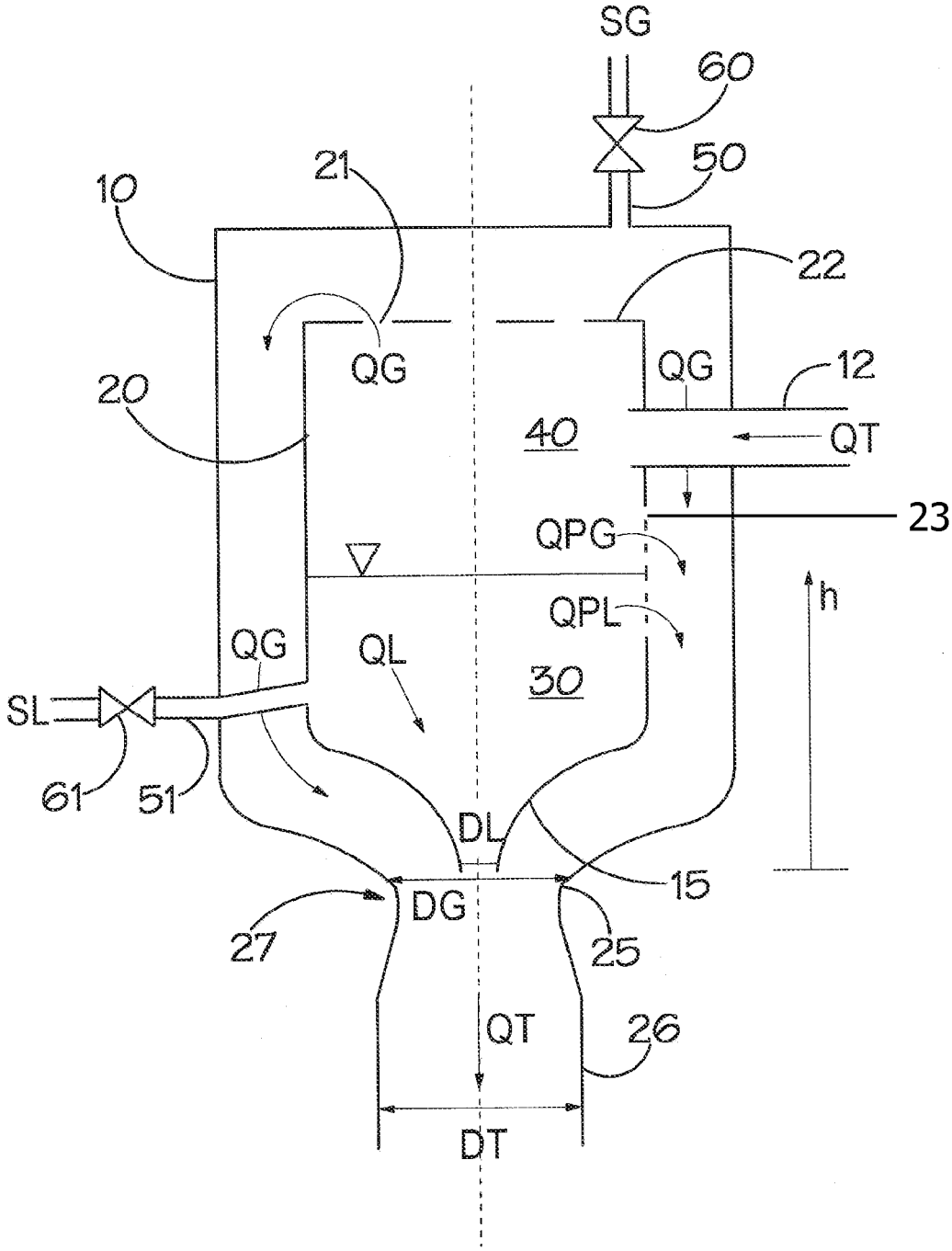
Figure 3:
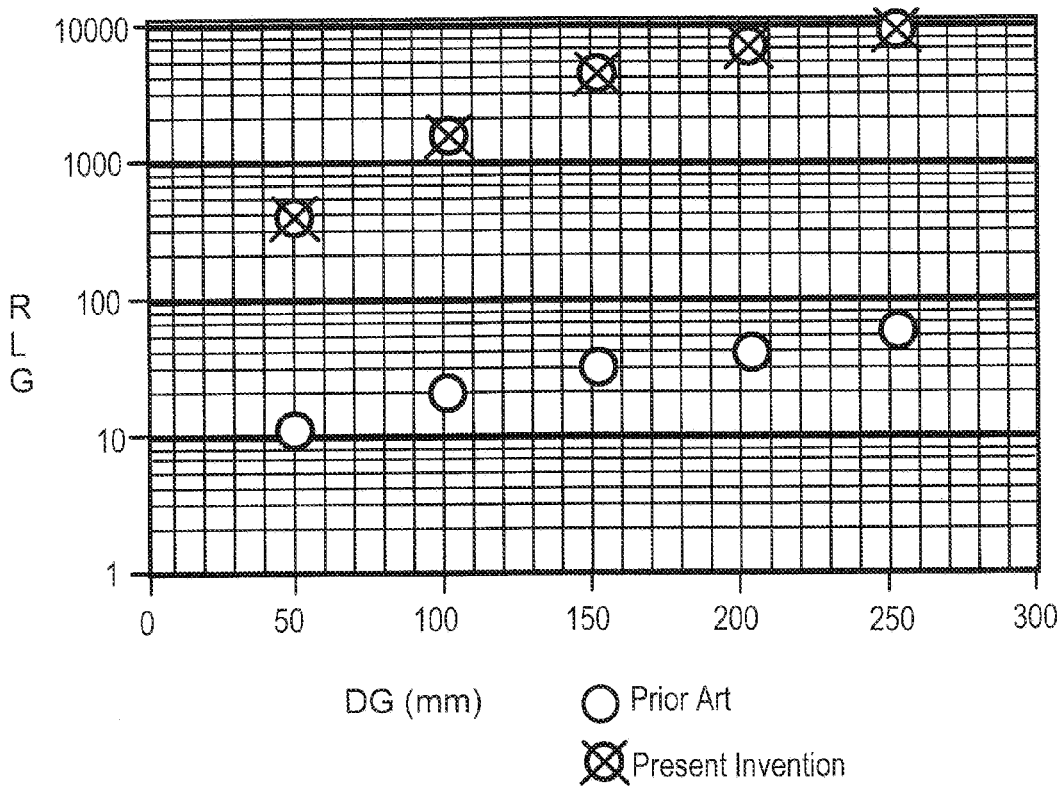
Figure 4:
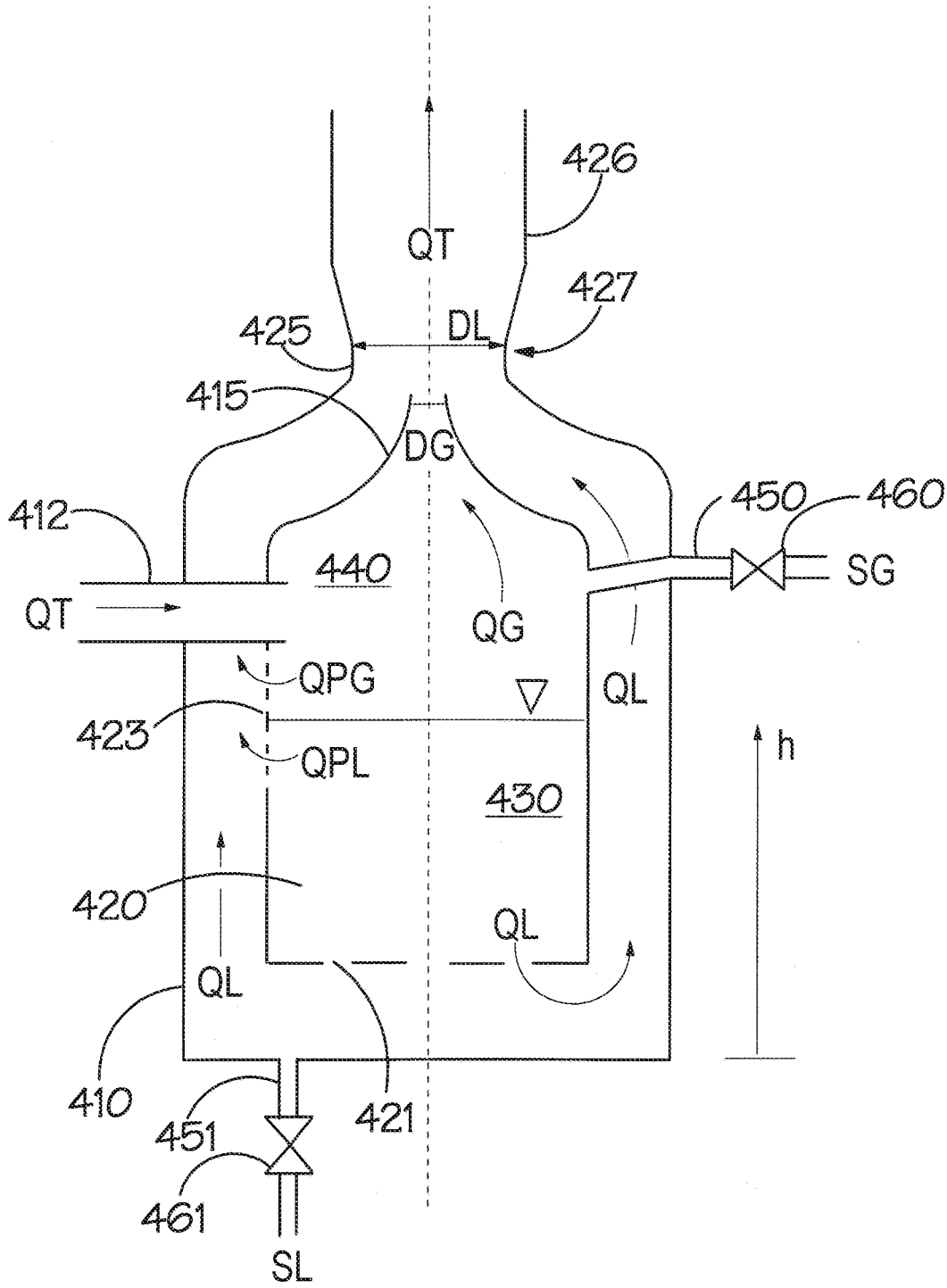

The invention is further described below, by way of example, with reference to the accompanying drawings, in which:

FIG. 1 is a schematic sectional view of one embodiment of a mixing homogenizing apparatus according to the invention;

FIG. 2 graphically illustrates a typical relationship between the liquid level in the apparatus of the prior art and the gas volume fraction (GVF) in the fluid output;

FIG. 3 graphically illustrates the advantage of this invention over the prior art; and FIG. 4 is a schematic sectional view of a second embodiment of apparatus according to the invention.

DETAILED DESCRIPTION OF THE DRAWINGS

The apparatus of FIG. 1 comprises a outer container 10 of generally upright cylindrical form of which the interior is closed, except for the fluid inlets and the outlets to be described. An inner vessel 20 is located within the container 10 and (in the illustrated embodiment) is coaxial with it.

At the upper region of the cylindrical side wall of the container 10 and vessel 20, there is an axial inlet port 12 bringing multi-phase fluid at a total flow rate QT (gas & liquid) from a source (not shown) into the interior of the inner vessel 20. Inside the vessel 20 the fluid tends to separate into different phases with liquid collecting in a pool 30 which has a depth h, and gas collecting in a body 40 adjacent to and above the liquid pool 30. In this configuration with a cylindrical shaped inner vessel (20) and a radial or axial inlet the separation is caused by gravity. An alternative configuration has a conical shaped inner vessel (20) and a tangential inlet and in that case separation is aided by centrifugal forces creating a cyclonic separation effect in addition to gravity. However an "upside-down" orientation with the outlet at the upper end is also possible as shown in FIG. 4 and described later. For both configurations a vertical downward flow through the vessel is the normal orientation with the outlet located at the lower end.

A plurality of gas outlet ports 21 in the roof 22 of the vessel 20 communicate with the outer container 10 and allow the flow of gas from the gas body 40 in the vessel 20 into the upper part of the container 10 at a flow rate QG. Gas and liquid also flow out into the container 10 through perforations 23 in the side of the inner vessel 20 at respective flow rates QPG and QPL.

The homogenizer comprises a fluid ejector 27 where liquid and gas are mixed. This comprises a liquid outlet port 15 located centrally in the base of the inner vessel 20 and a neck 25 of an outlet conduit 26 from the container 10. The neck 25 is normally located slightly downstream of the liquid outlet port 15 but this is not essential. The liquid outlet port 15 has a diameter DL discharging liquid L at a flow rate QL, into the gas flow QG in the neck 25. The neck 25 is pinched so that it has a diameter DG, at its narrowest, which is smaller than the diameter DT of the downstream outlet conduit 26.

The preferred ratio DG/DL depends on the application and is chosen to obtain a suitable flow mixer characteristic as explained in more detail in relation to FIG. 2.

One example of typical dimensions for the ejector 27 would be that the diameter DG of the neck portion 25 is 150 mm while the diameter of the liquid outlet port 15 is 10 mm so the ratio DG/DL is 15. In general, for oil and gas production applications the diameter DG would be between 20-300 mm and the diameter DL between 5 mm and (DG−10) mm which gives a ratio DG/DL of between 1.03 and 60. Typically a DG/DL ratio of above 2.5 is most appropriate for wet gas (high GVF) applications.

Since the neck 25 of the outlet conduit 26 is narrower than the outlet conduit 26 a venturi effect is created in the ejector 27 where the gas and liquid meet. This causes a higher fluid flow and reduced pressure which forms a turbulent shear layer in the venture extending downstream and providing an effective means of phase mixing of gas and liquid to form a homogenized multi-phase fluid flowing out of the outlet conduit 26 at a flow rate QT.

Different downstream devices such as a multiphase pump or a multiphase flow meter benefit from the mixing process because a well mixed flow is normally required in order to achieve optimum performance of multiphase devices. For example, even a pipe arrangement for splitting a multiphase stream in two or more equal streams is very unlikely to work properly unless the upstream flow is well mixed.

If the multi-phase fluid entering the apparatus is already homogenous or approximately so, then the fluid mixture will be discharged through the outlet pipe 26 by way of both the inner vessel outlet port 15 and the outer container outlet 26.

The production flow is driven by a reservoir pressure higher than a downstream pressure.

The objective of the sampling ports are to collect respectively liquid rich and gas rich fluid samples. The fluid samples are sampled carefully into a sampling bottle maintaining the process pressure and temperature. Normally the sampling operation will be carried out by use of an ROV (Remotely Operated Vessel) and the bottles (one with the liquid rich fluid and one with the gas rich fluid) will be brought to the surface and further to a laboratory where the fluids are analysed for their constituents and properties, particularly the water-oil ratio or water cut of the liquid phase.

This is particular useful when several well streams are combined subsea and routed to topside via a single pipeline. A topside sample will then only be representative for total combined flow and not be able to provide information from the individual well fluids. A subsea sampling unit located upstream the manifold will on the contrary be able to provide representative fluid samples from individual wells.

In combination with multiphase flow meters it might be particular useful to obtain the salt content of the water but also other fluid constituents such as sulphur etc. which influence the calibration coefficients of the flow meter.

Accurate multiphase flow measurements depends on a very precise description of the respective oil, water and gas phase properties. Normally phase densities, mass attenuation and/or electrical properties of the individual phases are required, and these properties will be influenced by different constituents such as the salt content of the water and sulphur content of the oil. Wet gas measurements will in particular also be sensitive to the gas properties.

As a supplement or in some cases alternative to a multiphase flow meter a subsea sampling device can be used to detect water break through and obtain the water cut particular at wet gas conditions where accurate measures are difficult to obtain from multiphase flow meters.

In some cases subsea sampling might be used stand-alone to detect chemical tracers identifying active production zones or simply to obtain fluid properties (other than flow rates) to better describe the reservoir and its fluid.

A subsea sampling process involves a lot of equipment, resources and cost. Due to the chaotic and non-predictability of a multiphase stream the risk of failing to obtain a representative sample of the different fluid phases has normally been high due to the lack of adequate sampling devices.

A sampling outlet 50 controlled by valve 60 is provided for sampling the gas rich stream SG of fluid in the outer container. For sampling the liquid rich stream SL in the pool 30 inside the vessel 20, a sampling outlet 51 is provided controlled by valve 61. Sampling the respective phases of the fluid in this way allows the process to be closely monitored and enables better and more accurate control. For example, flow can be adjusted for optimum performance for particular conditions.

FIG. 4 shows another embodiment of the invention in which the apparatus is essentially "upside-down". Equivalent features are prefaced with "4" for ease of reference.

Thus outer container 410 has an inner vessel 420, inlet port 412 for the multiphase fluid and fluid ejector 427 where the liquid and gas phases are mixed. The multiphase fluid separates into different phases, as in the first embodiment of the FIG. 1, with liquid collecting in a pool 430 to a depth h, and gas in a body 440 above the liquid pool 430. In this embodiment outlet ports 421 are in the base of vessel 420 and allow liquid to flow from the pool 430 into the container 410 at a flow rate QL. Perforations 423 in the side of the inner vessel 420 allows gas and liquid to flow out of the inner vessel 420.

The ejector 427 comprises inner outlet port 415 into the neck 425 of the container 410. It will be seen that the gas and liquid streams are essentially reversed in this embodiment in that gas flows predominantly from the inner vessel 420 through the inner outlet port 415 whereas liquid flows out of ports 421 and perforations 423 and through the ejector 427 via the neck 425.

Liquid sampling outlet 451 controlled by valve 461 exits from the outer container 410 in this embodiment and gas sampling outlet 450 controlled by valve 460 exits from the inner vessel 420.

The present invention has the effect of enabling a homogenizer to be designed for a relatively high gas volume fraction (GVF) by designing the unit with a small liquid to gas area ratio in the outlet without compromising the requirements for a minimum clearance in the liquid stream path to avoid blockage by particles.

For the purpose of demonstrating the added benefit of the present invention compared to known homogenizers, the relative amount of the volumetric gas flow rate will be expressed through the Gas Liquid Ratio (GLR) instead of the Gas Volume Fractions (GVF). The two terms are however related as described by the equation below. In the following it should be noted that the diameters DG and DL are taken in the same plane.

$$GLR = \frac{GVF}{1 - GVF} \qquad \text{Equation 1}$$

For the prior art homogenizer described in EP 0 379 319, without perforations, the following relation for the outlet GVF has been derived:

$$GVF = \frac{L \cdot \rho_L - \sqrt{L \cdot \rho_L \cdot G \cdot \rho_G + F \cdot (L \cdot \rho_L - G \cdot \rho_G)}}{L \cdot \rho_L - G \cdot \rho_G} \qquad \text{Equation 2}$$

Where L and G are geometric parameters, F is a flow parameter and $\rho_L$ and $\rho_G$ are the liquid and gas phase densities respectively. The flow parameter F is expressed as:

$$F = \frac{2 \cdot g \cdot h}{Q_T^2} \cdot (\rho_L - \rho_G) \qquad \text{Equation 3}$$

By introducing the liquid to gas area ratio $A_R$ in the ejector 27 defined as:

$$A_R = \left(\frac{A_L}{A_G}\right) \qquad \text{Equation 4}$$

where $A_L$ and $A_G$ are the respective liquid and gas flow areas in the ejector and making a few minor assumptions such as neglecting frictional losses it is possible to a derive an approximate expression for the outlet GVF or outlet GLR for a homogenizer without perforations as follows:

$$GLR = \frac{U_G}{A_R \cdot \sqrt{2 \cdot g \cdot h}} \qquad \text{Equation 5}$$

The effect of the perforations 23 is not described here as any perforations will tend to reduce the outlet GLR while the present invention aims to increase the outlet GLR. However the function of any perforations will be similar for the present invention as it is for the known homogenizers.

The relation for the outlet GLR as expressed by equation 5 is valid both for the present invention as well as for the known homogenizer. However the liquid to gas area ratio will be expressed differently as described below.

In known mixers, assuming that the wall of the central vessel 20 is relatively thin, and for high GLR applications the annulus clearance is small, then the hydraulic mean diameter of the annulus in the ejector 27 is close to the internal diameter of the central vessel 20, thus:

$$A_R \approx \frac{4 \cdot C}{DG} \qquad \text{Equation 6}$$

For the present invention the diameter of the liquid flow area DL in the ejector 27 will be named clearance (C), in order to show the relationship with the known homogenizer. Further, assuming that for high GLR applications the DL or C will be much smaller than the diameter of the gas flow area such that the area occupied by the liquid can be neglected when the gas flow area is calculated, thus:

$$A_R \approx \frac{C^2}{DG^2} \qquad \text{Equation 7}$$

Comparing the liquid to gas area ratio $A_R$ of the present invention to that of the prior art we can write:

$$\frac{GLR_{present\ inventions}}{GLR_{prior\ art}} \approx \frac{4 \cdot DG}{C} \qquad \text{Equation 8}$$

From equation 8 it will be observed that for typical dimensions the outlet GLR of the present invention can be increased in the order of up to 100 times compared with that of the known homogenizers.

The typical maximum outlet GLR that can be obtained with the present invention and compared with the prior art is shown in FIG. 3, assuming a liquid level of 0.5 m and a gas velocity of 12 m/s. For higher liquid levels the negative gradient of the characteristic curve can be reduced by introducing perforations if required to increase the GLR range of the apparatus.

It will be readily appreciated that the invention can be embodied in a variety of ways other than as specifically described and illustrated.

The invention claimed is:

1. An apparatus for homogenization of a multi-phase fluid comprising at least a first phase and a different second phase, the apparatus comprising:

an outer receptacle; and an inner reservoir fluidly communicative with the outer receptacle and wherein the first and second phases segregate, the inner reservoir comprising an inlet for the multiphase fluid, at least a first outlet for the first phase and at least a second outlet for the second phase, the first and the second outlets being in fluid communication with the outer receptacle;

wherein the outer receptacle comprises an outlet conduit having a neck, and wherein the neck is spaced from the second outlet and at least partially surrounds the first outlet, and wherein the multiphase fluid inlet extends through a wall of the outer receptacle across to an adjacent wall of the inner reservoir so that the multiphase fluid inlet brings the multiphase fluid from a source exterior to the outer receptacle into an interior of the inner reservoir.

2. Apparatus according to claim 1 wherein the inner reservoir comprises a conical shaped vessel.

3. Apparatus according to claim 1, wherein the first outlet and the outlet conduit are at the bottom of the apparatus in use, and wherein the first phase is a liquid phase and in the second phase in a gaseous phase.

4. Apparatus according to claim 1, wherein the first outlet and the outlet conduit are at the top of the apparatus in use, and wherein the first phase is a gaseous phase and the second phase is a liquid phase.

5. Apparatus according to claim 2, wherein the multi-phase fluid inlet in the inner reservoir is orientated radially with respect to the conical shaped vessel.

6. Apparatus according to claim 1 wherein the multi-phase fluid inlet is spaced from first outlet.

7. Apparatus according to claim 1 wherein a ratio of the diameter (DG) of the neck to the diameter (DL) of the first outlet is above 2.5.

8. Apparatus according to claim 7 wherein the ratio (DG/DL) is between 5 and 60.

9. Apparatus according to claim 8 wherein the ratio (DG/DL) is between 10 and 30.

10. Apparatus according to claim 9 wherein the ratio (DG/DL) is about 15.

11. Apparatus according to claim 1 wherein the inner reservoir comprises a plurality of openings for fluid to pass from the inner reservoir into the outer receptacle.

12. Apparatus according to claim 11 wherein at least one opening of the plurality of openings is at an end of the inner reservoir opposite to the first outlet.

13. Apparatus according to claim 11 wherein at least one opening of the plurality of openings is in a side of the inner reservoir between ends of the inner reservoir.

14. Apparatus according to claim 13 comprising a plurality of openings in the side of the inner reservoir.

15. Apparatus according to claim 1 wherein, in use, the neck creates a venturi effect in an ejector area of the outlet conduit.

16. Apparatus according to claim 1 comprising means to sample fluid in the outer receptacle.

17. Apparatus according to claim 1 comprising means to sample fluid in the inner reservoir.

18. A method for homogenizing multi-phase fluid comprising at least a first phase and a different second phase, the method comprising:

supplying the multi-phase fluid through a multiphase fluid inlet to an inner reservoir which is at least partially surrounded by an outer receptacle comprising an outlet having a neck providing, in use, a venturi, wherein the multiphase fluid inlet extends through a wall of the outer receptacle across to an adjacent wall of the inner reservoir so that the multiphase fluid inlet brings the multiphase fluid from a source exterior to the outer receptacle into an interior of the inner reservoir;

allowing the at least first and second phases of the multiphase fluid to segregate in the inner reservoir; and drawing off an outlet stream of a first fluid from the inner reservoir through a first outlet and the venturi so that fluid is drawn through the outer receptacle into the first outlet and a stream of a second fluid from the inner reservoir through a second outlet; and allowing the first and second fluids to mix in the venturi provided by the neck while going through the outlet conduit of the outer receptacle.

19. A method according to claim 18 wherein the inner reservoir comprises a conical shaped vessel and the multiphase fluid is supplied through the inlet radially orientated with respect to the reservoir.

20. A method according to claim 18 wherein a ratio of a diameter (DG) of the outer receptacle outlet neck to a diameter (DL) of the first the outlet is between 10 and 30.

21. A method according to claim 18, comprising sampling fluid in the outer receptacle.

22. A method according to claim 18, comprising sampling fluid in the inner reservoir.

* * * * *